US011293251B2

(12) United States Patent
Donald et al.

(10) Patent No.: US 11,293,251 B2
(45) Date of Patent: Apr. 5, 2022

(54) APPARATUS, SYSTEMS AND METHODS FOR OIL AND GAS OPERATIONS

(71) Applicant: Enpro Subsea Limited, Aberdeen (GB)

(72) Inventors: Ian Donald, Inverurie (GB); John Reid, Perthshire (GB); Craig McDonald, Aberdeen (GB)

(73) Assignee: Enpro Subsea Limited, Aberdeen (GB)

( * ) Notice: Subject to any disclaimer, the term of this patent is extended or adjusted under 35 U.S.C. 154(b) by 0 days.

(21) Appl. No.: 16/979,079

(22) PCT Filed: Apr. 18, 2019

(86) PCT No.: PCT/GB2019/051116

§ 371 (c)(1),
(2) Date: Sep. 8, 2020

(87) PCT Pub. No.: WO2019/202336

PCT Pub. Date: Oct. 24, 2019

(65) Prior Publication Data

US 2021/0054713 A1 Feb. 25, 2021

(30) Foreign Application Priority Data

| | | |
|---|---|---|
| Apr. 21, 2018 | (GB) | 1806515 |
| May 18, 2018 | (GB) | 1808098 |
| Jan. 30, 2019 | (GB) | 1901258 |

(51) Int. Cl.
*E21B 33/076* (2006.01)
*E21B 47/001* (2012.01)
(Continued)

(52) U.S. Cl.
CPC ..... *E21B 33/076* (2013.01); *E21B 37/06* (2013.01); *E21B 43/013* (2013.01); *E21B 47/001* (2020.05); *E21B 47/07* (2020.05)

(58) Field of Classification Search
CPC ..... E21B 33/038; E21B 33/076; E21B 37/06; E21B 41/0007; E21B 43/013;
(Continued)

(56) References Cited

U.S. PATENT DOCUMENTS

| | | | | |
|---|---|---|---|---|
| 3,973,587 | A | 8/1976 | Cochran | |
| 2004/0043501 | A1 * | 3/2004 | Means | E21B 33/1275 436/164 |

(Continued)

FOREIGN PATENT DOCUMENTS

| | | | | |
|---|---|---|---|---|
| GB | 2480427 | A | 11/2011 | |
| WO | WO-0116459 | A1 * | 3/2001 | E21B 37/06 |

(Continued)

*Primary Examiner* — James G Sayre
(74) *Attorney, Agent, or Firm* — Holzer Patel Drennan

(57) ABSTRACT

The invention provides an apparatus for introducing a fluid into a subsea production flow system, a system and a method of use. The apparatus comprises a first flow path through the apparatus for fluidly coupling a subsea well to a subsea production flow system and an inlet for receiving a fluid. A second flow path fluidly connects the inlet and the subsea production flow system. A valve is operable to control the flow of the fluid through the inlet to the subsea production flow system. In one embodiment, the invention provides an apparatus for preventing or reducing flow of a first treatment chemical into a subsea production flow system, a system, and a method of use. In an alternative embodiment, the invention provides an apparatus for injecting a gas into a subsea production flow system, a system, and a method of use.

24 Claims, 9 Drawing Sheets

(51) Int. Cl.
*E21B 47/07* (2012.01)
*E21B 37/06* (2006.01)
*E21B 43/013* (2006.01)

(58) Field of Classification Search
CPC .... E21B 47/001; E21B 47/07; E21B 33/0353; E21B 33/0387
See application file for complete search history.

(56) References Cited

U.S. PATENT DOCUMENTS

| | | | | |
|---|---|---|---|---|
| 2004/0168811 | A1 | 9/2004 | Shaw et al. | |
| 2006/0108120 | A1* | 5/2006 | Saucier | E21B 34/04 166/344 |
| 2015/0136409 | A1* | 5/2015 | Hall | E21B 33/0355 166/344 |
| 2016/0369598 | A1 | 12/2016 | Smedstad | |

FOREIGN PATENT DOCUMENTS

| | | | |
|---|---|---|---|
| WO | 2013121212 | A2 | 8/2013 |
| WO | 2016097717 | A2 | 6/2016 |
| WO | 2016166534 | A1 | 10/2016 |
| WO | 2018106835 | A1 | 6/2018 |

* cited by examiner

APPARATUS, SYSTEMS AND METHODS FOR OIL AND GAS OPERATIONS

The present invention relates to apparatus, systems and methods for oil and gas operations. In particular, the present invention relates to apparatus, systems and methods for administering or delivering fluids to subsea hydrocarbon production flow systems. The invention has particular, but not exclusive application to scale squeeze operations for hydrocarbon wells, and gas lift operations for production pipelines, flow lines and risers.

BACKGROUND TO THE INVENTION

In the field of subsea engineering for the hydrocarbon production industry, it is known to introduce fluids to subsea flow systems and/or hydrocarbon wells. In some such applications, chemicals are injected in the flow systems and/or hydrocarbon wells to treat the flow system, the well, or the reservoir itself. For example, a scale squeeze operation, is carried out to remove unwanted build-up of scale and deposits inside the production tubing of a subsea well by the injection of chemicals from a pumping skid on a vessel or a subsea module.

Other fluid injection operations are used to optimise hydrocarbon production. For example, gas-lift methods involve injecting gas into the flow of production fluid in a pipeline and/or at the base of the riser in order to reduce its density, thus making it easier to recover to surface.

Typically, appropriate dosing of the treatment chemical is calculated to provide effective treatment without a significant excess of the treatment chemical, which may be harmful to the downstream subsea production flow system, particularly where the flow system comprises components susceptible to damage or corrosion. Examples include production flow systems that comprise carbon steel, titanium (including flexible riser joints) or elastomeric components or other systems which are not fully comprised of corrosion resistant alloys. However, it can be difficult to fully eliminate or reduce to an acceptable level the excess in treatment chemical, which may result in unspent chemicals passing through the production system when production commences. This flow back of treatment chemicals can be detrimental to the integrity of the system.

SUMMARY OF THE INVENTION

There is generally a need for a method and apparatus which addresses one or more of the problems identified above.

It is amongst the aims and objects of the invention to provide a method and/or apparatus that obviates or mitigates one or more drawbacks or disadvantages of available subsea fluid injection systems and methodology, including chemical treatment systems for subsea wells and/or production flow systems and gas lift systems and method.

Other aims and objects will become apparent from the following description.

According to a first aspect of the invention, there is provided an apparatus for introducing a fluid into a subsea production flow system, the apparatus comprising:

a first flow path through the apparatus for fluidly coupling a subsea well to a subsea production flow system;

an inlet for receiving the introduced fluid;

a second flow path fluidly connecting the inlet and the subsea production flow system;

a valve operable to control the flow of the introduced fluid through the inlet to the subsea production flow system; and at least one flow barrier in the first flow path, preventing the passage of the introduced fluid from the inlet to the subsea well.

The apparatus may be configured to be connected to the flow system anywhere in the jumper flowline envelope of the flow system.

The apparatus may be configured to be connected to an external flowline connector of the flow system or a manifold thereof, at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT). Alternatively, or in addition, the apparatus may be configured to be connected (directly or otherwise) to a production riser, such that it is in fluid communication with the production riser.

The apparatus may be configured to be connected to an external flowline connector of any: jumper flow line; section of a jumper flow line; Christmas tree; subsea collection manifold system; subsea Pipe Line End Manifold (PLEM); subsea Pipe Line End Termination (PLET); subsea Flow Line End Termination (FLET); subsea in-line tee (ILT); and production riser.

The apparatus may be connected to the flow system directly. Alternatively, the apparatus may be located (partially or wholly) on a flow access apparatus (or multiple flow access apparatus) which is located on the flow system.

The second flow path may connect the inlet to the subsea production flow system via at least a part of the first flow path. The first and second flow paths may be in fluid communication.

The at least one flow barrier may be a check valve.

The at least one flow barrier may be a flow restrictor, such as a choke valve. A controllable choke valve may be provided which is operable to create a flow restriction and which may create pressure drop in the system. This may result in a favourable flow route for the introduced fluid upon entry into the apparatus via the valve and the inlet. The pressure drop generated may cause the introduced fluid to preferentially flow through the second flow path to the production flow system, and may inhibit or prevent flow of the introduced fluid to the first flow path.

Alternatively, the at least one flow barrier may be a choke valve.

The valve operable to control the flow of the introduced fluid through the inlet may be located externally to a main body of the apparatus. Alternatively, the valve may be located internally to a main body of the apparatus. The valve may be a controllable valve.

The apparatus may be operable to transmit a signal to a control module. The control module may be local to the apparatus in use. Alternatively, or in addition, the control module may be remote from the apparatus in use, and may for example be located on a surface vessel.

The apparatus may be used for preventing or reducing flow of a first treatment chemical into the subsea production flow system. In this application, the inlet may be configured for receiving a second treatment chemical. The apparatus may comprise a first sensor which may be operable to detect a condition indicative of the first treatment chemical in the apparatus and which may transmit a signal to the control module. The valve may be a dosing valve which may be operable to control the flow of the second treatment chemical through the inlet to the subsea production flow system which may be in response to a control signal from the control module. The at least one flow barrier may be disposed between the inlet and the at least one sensor. The at least one sensor may be a pH sensor.

The apparatus may be used for injecting a gas into the subsea production flow system for a gas lift operation. In this application, the inlet may be configured for receiving gas. The valve may be operable to control the flow of gas through the inlet to the subsea production flow system. The at least one flow barrier may prevent the passage of the gas from the inlet to the subsea well.

The inlet for receiving the gas may be in the form of a hot stab receptacle which may be configured to receive a hot stab connector. The hot stab connector may be an ROV hot stab connector.

Alternatively, or in addition, the inlet for receiving gas may be configured to receive gas from one or more gas delivery lines. The gas delivery lines may be provided by an umbilical.

The second flow path may comprise additional valves and/or flow components required for the gas lift operation. For example, the second flow path may comprise an injection check valve and/or an injection nozzle.

The second flow path may comprise additional instrumentation for monitoring fluid and/or flow properties such as pressure, temperature, flow rate and fluid composition. The second flow path may comprise, for example, a pressure and temperature transducer (PTT) operable to measure characteristics of the fluid within the apparatus. Alternatively, or in addition, the second flow path comprises a flow meter operable to measure and monitor the properties of production flow in the second flow path following dosing and/or gas injection.

Instrumentation within the first and/or second flow paths may be operable to feedback to the control module, and dosing rates, gas injection rates or other properties of the flow operation may be adjusted based on feedback from the instrumentation.

Valves and instrumentation included in the control module may be controlled hydraulically and/or electronically.

According to a second aspect of the invention, there is provided a method of introducing a fluid to a subsea production flow system, the method comprising:

providing an apparatus fluidly connected to a subsea well and a subsea production flow system, the apparatus comprising an inlet for receiving the introduced fluid and at least one flow barrier preventing passage of the introduced fluid from the inlet to the subsea well;

flowing a production fluid from the subsea well into the apparatus;

controlling flow of the introduced fluid into the apparatus, through the inlet and in to the subsea production flow system; and flowing the production fluid and introduced fluid to the subsea production flow system.

The method may be for preventing or reducing flow of a first treatment chemical into the subsea production flow system. The method may comprise detecting in the production fluid a condition indicative of a first treatment chemical which may be done by using a first sensor in the apparatus. The introduced fluid may be a second treatment chemical. The method may comprise controlling the flow of the second treatment chemical into the apparatus which may be for the purpose of dosing the production fluid to counteract an effect of the first treatment chemical. The method may comprise flowing the dosed production fluid to the subsea production flow system.

The condition indicative of a first treatment chemical may be a pH outside of a desired pH range. The condition may be pH lower than a desired threshold.

The second treatment chemical may be a base substance, and/or an alkaline or caustic chemical selected to raise the pH of the production fluid to above a desired threshold. The second treatment chemical may, for example, be a caustic soda, or another suitable basic chemical.

The method may be for injecting a gas into the subsea production flow system. The introduced fluid may be gas. The method may comprise controlling flow of the gas into the apparatus, through the inlet and in to the subsea production flow system. The method may comprise flowing the production fluid and gas to the subsea production flow system.

The method may comprise adjusting gas injection rates and/or other properties of the gas injection operation based on feedback from instrumentation within the apparatus.

The instrumentation may be operable to monitor properties of production fluid in the apparatus, prior to and following gas injection. For example, the instrumentation may be able to monitor the pressure, temperature, flow rate and/or fluid composition of the production fluid.

Embodiments of the second aspect of the invention may include one or more features of the first aspect of the invention or its embodiments, or vice versa.

According to a third aspect of the invention, there is provided a system for introducing a fluid to a subsea production flow system, the system comprising:

a subsea well;

a subsea production flow system;

an apparatus fluidly coupling the subsea well to the subsea production flow system via a first flow path, wherein the apparatus further comprises an inlet for receiving the introduced fluid and a second flow path between the inlet and the subsea production flow system;

wherein the apparatus further comprises a valve operable to control the flow of the introduced fluid through the inlet to the subsea production flow system; and wherein the apparatus further comprises at least one flow barrier in the first flow path, preventing the passage of the introduced fluid from the inlet to the subsea well.

The second flow path may connect the inlet to the subsea production flow system via at least a part of the first flow path.

The apparatus may be connected to an external flowline connector of the flow system or a manifold thereof, at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT). Alternatively, or in addition, the apparatus may be connected (directly or otherwise) to a production riser, such that it is in fluid communication with the production riser.

The apparatus may be connected to an external flowline connector of any: jumper flow line; section of a jumper flow line; Christmas tree; subsea collection manifold system; subsea Pipe Line End Manifold (PLEM); subsea Pipe Line End Termination (PLET); subsea Flow Line End Termination (FLET); subsea in-line tee (ILT); and production riser.

The apparatus may be connected to a flow access apparatus. The flow access apparatus may be connected to a jumper flowline connector in the jumper flowline envelope of a subsea tree and a jumper flowline of the production flow system.

The flow access apparatus may be connected to an external flowline connector of the flow system or a manifold thereof, at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT). Alternatively, or in addition, the flow access apparatus may be connected (directly or otherwise) to a production riser, such that it is in fluid communication with the production riser.

The flow access apparatus may be connected to an external flowline connector of any: jumper flow line; section of a jumper flow line; Christmas tree; subsea collection manifold system; subsea Pipe Line End Manifold (PLEM); subsea Pipe Line End Termination (PLET); subsea Flow Line End Termination (FLET); subsea in-line tee (ILT); and production riser The apparatus may be fluidly connected to a production riser.

Embodiments of the third aspect of the invention may include one or more features of the first and second aspects of the invention or their embodiments, or vice versa.

According to a fourth aspect of the invention, there is provided an apparatus for preventing or reducing flow of a first treatment chemical into a subsea production flow system, the apparatus comprising:

a first flow path through the apparatus for fluidly coupling a subsea well to a subsea production flow system;

an inlet for receiving a second treatment chemical; and a second flow path fluidly connecting the inlet and the subsea production flow system;

a first sensor for detecting a condition indicative of the first treatment chemical in the apparatus and transmitting a signal to a control module; and a dosing valve operable to control the flow of the second treatment chemical through the inlet to the subsea production flow system in response to a control signal from the control module.

The second flow path may connect the inlet to the subsea production flow system via at least a part of the first flow path.

Preferably, the apparatus comprises at least one flow barrier in the first flow path, preventing the passage of fluid from the inlet to the subsea well. The at least one flow barrier may be a check valve.

The at least one flow barrier is preferably disposed between the inlet and the at least one sensor.

Preferably the sensor is a pH sensor.

The control module may be local to the apparatus in use. Alternatively, the control module may be remote from the apparatus in use, and may for example be located on a surface vessel.

Embodiments of the fourth aspect of the invention may include one or more features of the first to third aspects of the invention or their embodiments, or vice versa.

According to a fifth aspect of the invention, there is provided a method of preventing or reducing flow of a first treatment chemical into a subsea production flow system, the method comprising:

flowing a production fluid from a subsea well into an apparatus fluidly connected to the subsea well, and to a subsea production flow system;

detecting in the production fluid a condition indicative of a first treatment chemical using a first sensor in the apparatus;

controlling the flow of a second treatment chemical into the apparatus to dose the production fluid and counteract an effect of the first treatment chemical; and flowing the dosed production fluid to the subsea production flow system.

The condition indicative of a first treatment chemical may be a pH outside of a desired pH range. The condition may be pH lower than a desired threshold.

The second treatment chemical may be a base substance, and/or an alkaline or caustic chemical selected to raise the pH of the production fluid to above a desired threshold. The second treatment chemical may, for example, be a caustic soda, or another suitable basic chemical.

Embodiments of the fifth aspect of the invention may include one or more features of the first to fourth aspects of the invention or their embodiments, or vice versa.

According to a sixth aspect of the invention, there is provided a system for preventing or reducing flow of a first treatment chemical into a subsea production flow system, the system comprising:

a subsea well;

a subsea production flow system;

an apparatus fluidly coupling the subsea well to the subsea production flow system via a first flow path, wherein the apparatus further comprises an inlet for receiving a second treatment chemical, and a second flow path between the inlet and the subsea production flow system;

wherein the apparatus comprises at least one treatment chemical sensor for detecting a condition indicative of the first treatment chemical in the apparatus and transmitting a signal to a control module; and wherein the apparatus further comprises a dosing valve operable to control the flow of the second treatment chemical through the inlet to the subsea production flow system in response to a control signal from the control module.

The second flow path may connect the inlet to the subsea production flow system via at least a part of the first flow path.

Embodiments of the sixth aspect of the invention may include one or more features of the first to fifth aspects of the invention or their embodiments, or vice versa.

According to a seventh aspect of the invention, there is provided an apparatus for injecting a gas into a subsea production flow system for a gas lift operation, the apparatus comprising:

a first flow path through the apparatus for fluidly coupling a subsea well to a subsea production flow system;

an inlet for receiving the gas;

a second flow path fluidly connecting the inlet and the subsea production flow system; a valve operable to control the flow of gas through the inlet to the subsea production flow system; and at least one flow barrier in the first flow path, preventing the passage of the gas from the inlet to the subsea well.

The second flow path may connect the inlet to the subsea production flow system via at least a part of the first flow path.

The inlet for receiving the gas may be in the form of a hot stab receptacle which may be configured to receive a hot stab connector. The hot stab connector may be an ROV hot stab connector.

Alternatively, or in addition, the inlet for receiving gas may be configured to receive gas from one or more gas delivery lines. The gas delivery lines may be provided by an umbilical.

The second flow path may comprise additional valves and/or flow components required for the gas lift operation. For example, the second flow path may comprise an injection check valve and/or an injection nozzle.

The second flow path may comprise additional instrumentation for monitoring properties such as pressure, temperature, flow rate and fluid composition. The second flow path may comprise, for example, a pressure and temperature transducer (PTT) operable to measure characteristics of the fluid within the apparatus. Alternatively, or in addition, the second flow path comprises a flow meter operable to measure and monitor the properties of production flow in the second flow path following gas injection.

Instrumentation within the first and/or second flow paths may be operable to feedback to a control module, and gas injection rates or other properties of the gas injection operation may be adjusted based on feedback from the instrumentation.

The control module may be local to the apparatus in use. Alternatively, the control module may be remote from the apparatus in use, and may for example be located on a surface vessel.

Valves and instrumentation included in the control module may be controlled hydraulically and/or electronically.

The apparatus may be configured to be connected to the subsea production flow system anywhere in the jumper flowline envelope of the flow system.

The apparatus may be configured to be connected to an external flowline connector of the flow system or a manifold thereof, at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT).

Alternatively, or in addition, the apparatus may be configured to be connected (directly or otherwise) to a production riser, such that it is in fluid communication with the production riser.

Embodiments of the seventh aspect of the invention may include one or more features of the first to sixth aspects of the invention or their embodiments, or vice versa.

According to an eighth aspect of the invention, there is provided a method of injecting a gas into a subsea production flow system, the method comprising:

providing an apparatus fluidly connected to a subsea well and a subsea production flow system, the apparatus comprising an inlet for receiving the gas and at least one flow barrier preventing passage of the gas from the inlet to the subsea well;

flowing a production fluid from the subsea well into the apparatus;

controlling flow of the gas into the apparatus, through the inlet and in to the subsea production flow system; and flowing the production fluid and gas to the subsea production flow system.

The method may comprise adjusting gas injection rates and/or other properties of the gas injection operation based on feedback from instrumentation within the apparatus.

The instrumentation may be operable to monitor properties of production fluid in the apparatus, prior to and following gas injection. For example, the instrumentation may be able to monitor the pressure, temperature, flow rate and/or fluid composition of the production fluid.

Embodiments of the eighth aspect of the invention may include one or more features of the first to seventh aspects of the invention or their embodiments, or vice versa.

According to a ninth aspect of the invention, there is provided a system for injecting a gas to a subsea production flow system, the system comprising:

a subsea well;

a subsea production flow system;

an apparatus fluidly coupling the subsea well to the subsea production flow system via a first flow path, wherein the apparatus further comprises an inlet for receiving the gas and a second flow path between the inlet and the subsea production flow system;

wherein the apparatus further comprises a valve operable to control the flow of the gas through the inlet to the subsea production flow system; and wherein the apparatus further comprises at least one flow barrier in the first flow path, preventing the passage of the gas from the inlet to the subsea well.

The second flow path may connect the inlet to the subsea production flow system via at least a part of the first flow path.

The apparatus may be connected to the subsea production flow system anywhere in the jumper flowline envelope of the flow system.

The apparatus may be connected to an external flowline connector of the flow system or a manifold thereof, at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT).

Alternatively, or in addition, the apparatus may be connected (directly or otherwise) to a production riser, such that it is in fluid communication with the production riser. Embodiments of the ninth aspect of the invention may include one or more features of the first to eighth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
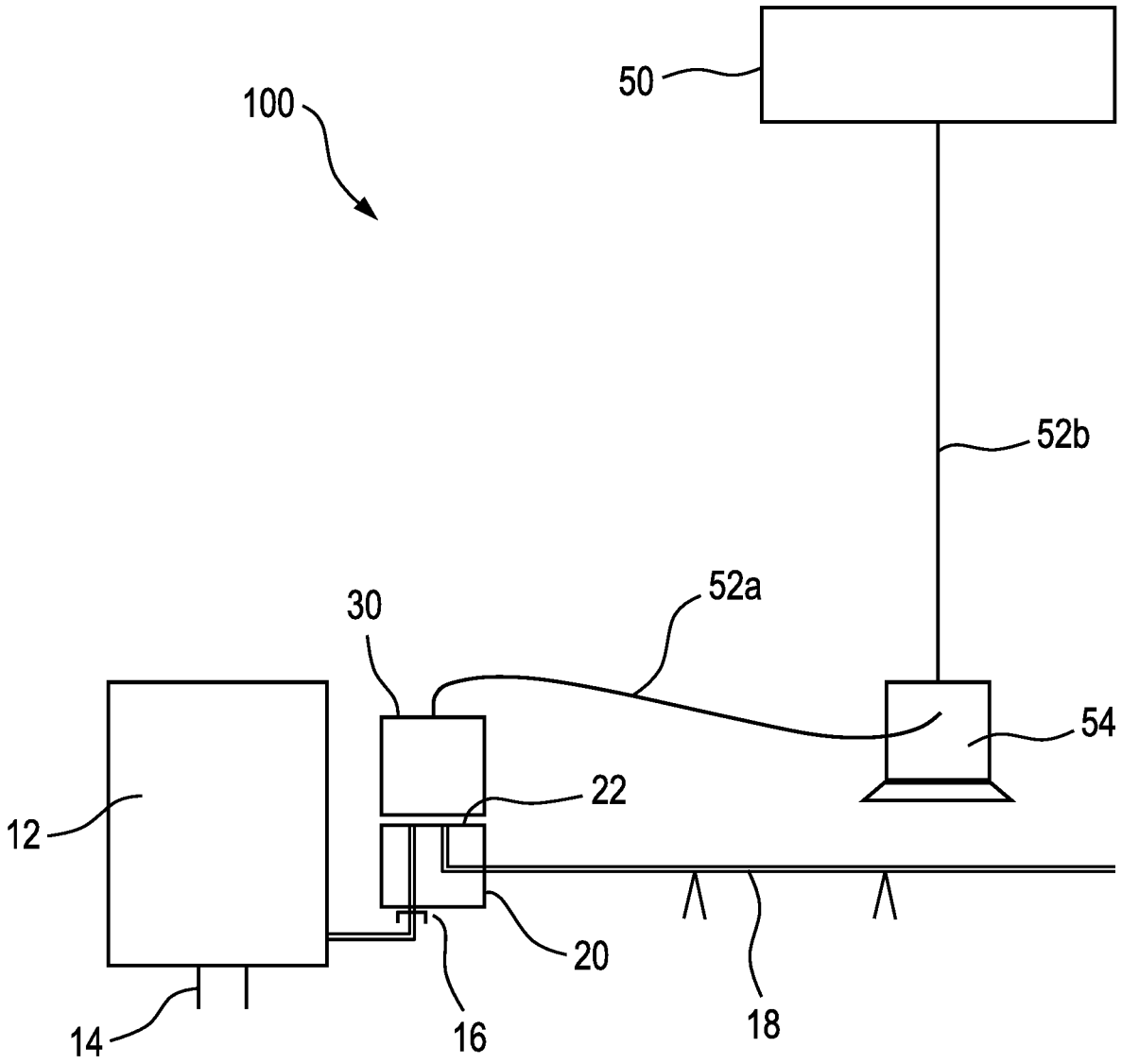
FIG. 1 is a schematic view of a subsea production flow system with an apparatus according to an embodiment of the invention.

Referring firstly to FIG. 1, there is shown generally at 100 a subsea production flow system. The system comprises a subsea tree 12 on a subsea well 14. The subsea tree 12 has a jumper flowline connector 16, which defines the boundary of the tree envelope, and which conventionally a production jumper flowline would be connected to convey production fluids to the production flow system 18 downstream of the tree 12.

In the configuration shown, a flow access apparatus 20 is connected to the jumper flowline connector 16 in the jumper flowline envelope, between the subsea tree and the jumper flowline of the production flow system. The flow access apparatus 20 is a dual bore access hub of the type described in the applicant's international patent publication number WO 2016/097717, and facilitates fluid intervention to the subsea well and/or production flow system through a single interface 22. In this embodiment, prior to the configuration shown in FIG. 1, the flow access apparatus 20 has enabled flow access to the subsea well in a scale squeeze operation, via a dedicated chemical injection module (not shown) connected to the interface 22. The scale squeeze operation has injected a first treatment chemical, which in this case is an acid such hydrochloric acid or hydrofluoric acid, into the subsea well. Subsequent to the treatment operation, the well is shut in, the dedicated chemical injection module (not shown) is removed, and the module 30 is connected to the hub, as shown in FIG. 1. The module 30 is connected to a surface vessel 50 or other surface facility by a fluid and communications control umbilical 52, in this case via a subsea module 54 (such that the control umbilical is shown in two sections 52*a* and 52*b*).

Figure 2:
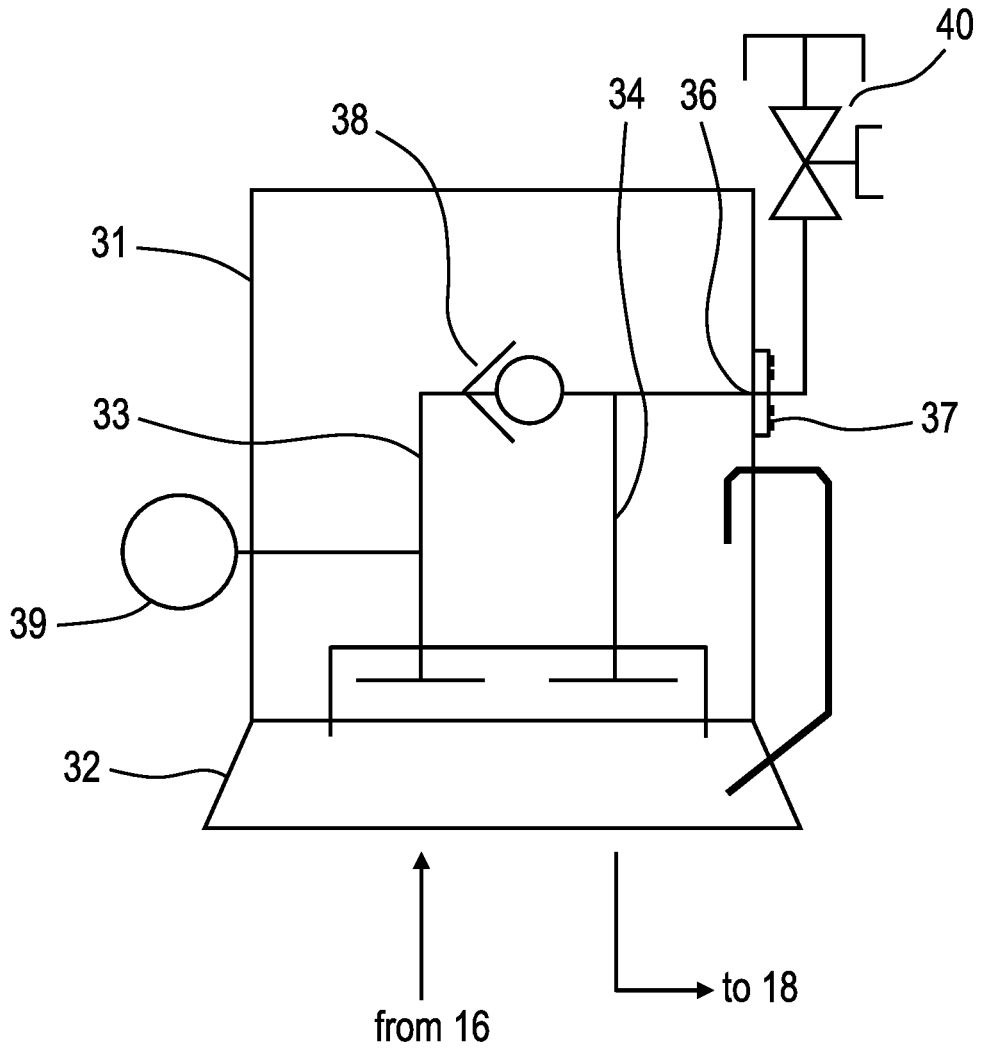
FIG. 2 is a schematic view of an apparatus according to an embodiment of the invention.

FIG. 2 is a schematic view of the module 30. The module comprises a body 31 with a lower interface for coupling the module to the interface 22 of the access apparatus 20. A guide funnel 32 facilitates connection of the module to the interface 22 of the access apparatus. A first bore 33 extends through the body 31 from the lower interface connection to the jumper flowline connector 16. A second bore 34 extends through the body 31 from the lower interface connection to the production flowline 18. The first and second bores are connected to one another via a check valve 38, which permits flow of fluid in the direction from the subsea tree to the production flow system, but prevents flow in the opposing direction. Together the first and second bores define a first flow path through the apparatus for production fluid.

The body also comprises an inlet 36 to the second bore on the production flow system side of the check valve 38. The inlet 36 enables fluid to be passed through the apparatus and into the production flow system, from a fluid source (not shown) on an opposing side of a dosing valve 40. In this embodiment, the dosing valve 40 is shown externally to the main body 31 of the apparatus, connected by a studded connection 37, but it will be appreciated that in other embodiments in the valve may be internal to the body 31.

The apparatus also comprises sensor 39, capable of monitoring the fluid in the apparatus, and detecting a characteristic indicative of the presence of a treatment chemical in the fluid. The treatment chemical may be the treatment chemical injected in a previous treatment operation, or a reaction product of the injected chemical. In this case, the sensor is a pH sensor, capable of detecting the pH of the production fluid. The sensor generates an output signal to a control module (not shown). If the control module determines that the pH of the fluid is not within a desired range, for example is too low (acidic) for flow through the production flow system without risk of detrimental effects, the control module generates a signal to open the dosing valve 40 to enable a second treatment chemical to enter the inlet 36 to the production flow. The second treatment chemical is in this case an alkaline or caustic fluid such as caustic soda, which is administered to raise the pH of the fluid to within a desired range. The check valve 38 prevents flow of the second treatment chemical to the first bore, at which the pH sensor is located, so that the second treatment chemical does not interfere with the monitoring of the inflowing production fluid.

It will be appreciated that scale squeeze operations may utilise a range of different chemical treatments including a variety of acids or other solvents, and the invention extends to such embodiments, with appropriate sensors and use of appropriate second treatment chemicals to counteract an adverse condition detected in the fluid.

Figure 3:
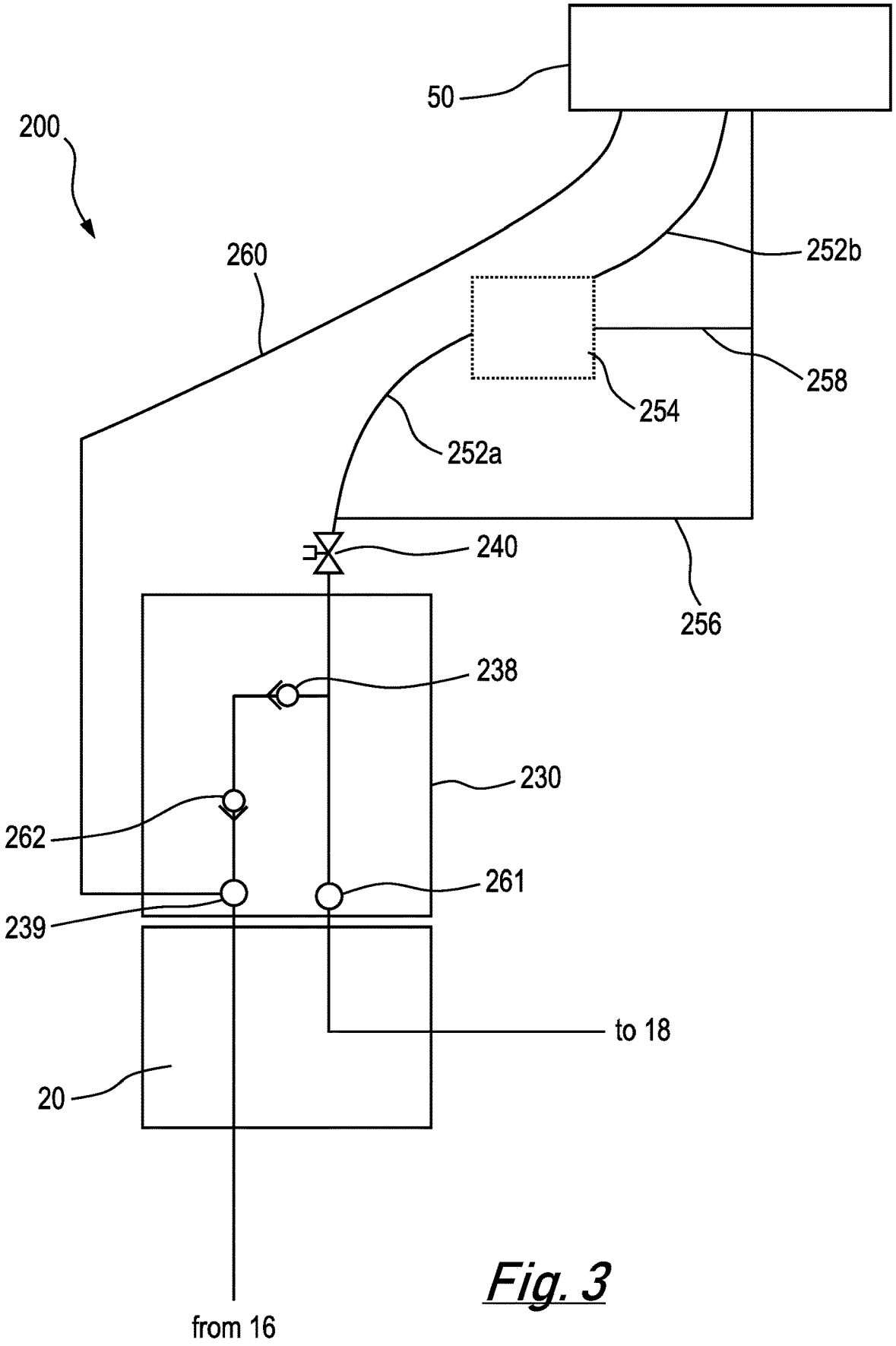
FIG. 3 is a schematic process and instrumentation diagram of a vessel-controlled system according to an embodiment of the invention.

FIG. 3 is a schematic representation of a system according to an alternative embodiment of the invention. The system, generally shown at 200, is similar to the system 100 incorporating the module 30, and will be understood from FIGS. 1 and 2 and their accompanying description. Like features are given like reference numerals incremented by 100. The system 200 differs from the system 100 in that the module 230 comprises an additional sensor 261 on the production flow system side of the check valve 238, to enable monitoring of a characteristic of the fluid as it passes through the module and after it has been dosed with a second treatment chemical. The module also comprises an additional check valve 262 disposed between the sensor 239 and the check valve 238.

The system 200 is configured to be controlled remotely from a vessel 50 at surface, via control lines 256, 258, and 260. A signal indicative of adverse fluid characteristics is sent from the sensors 239 and/or 261 to a control module on the vessel, and a control signal is sent from the control module to operate the subsea skid 254 and the dosing valve 240 to deliver the second treatment chemical from the vessel 50 via a flowline or hose 252*a*/252*b*.

Figure 4:
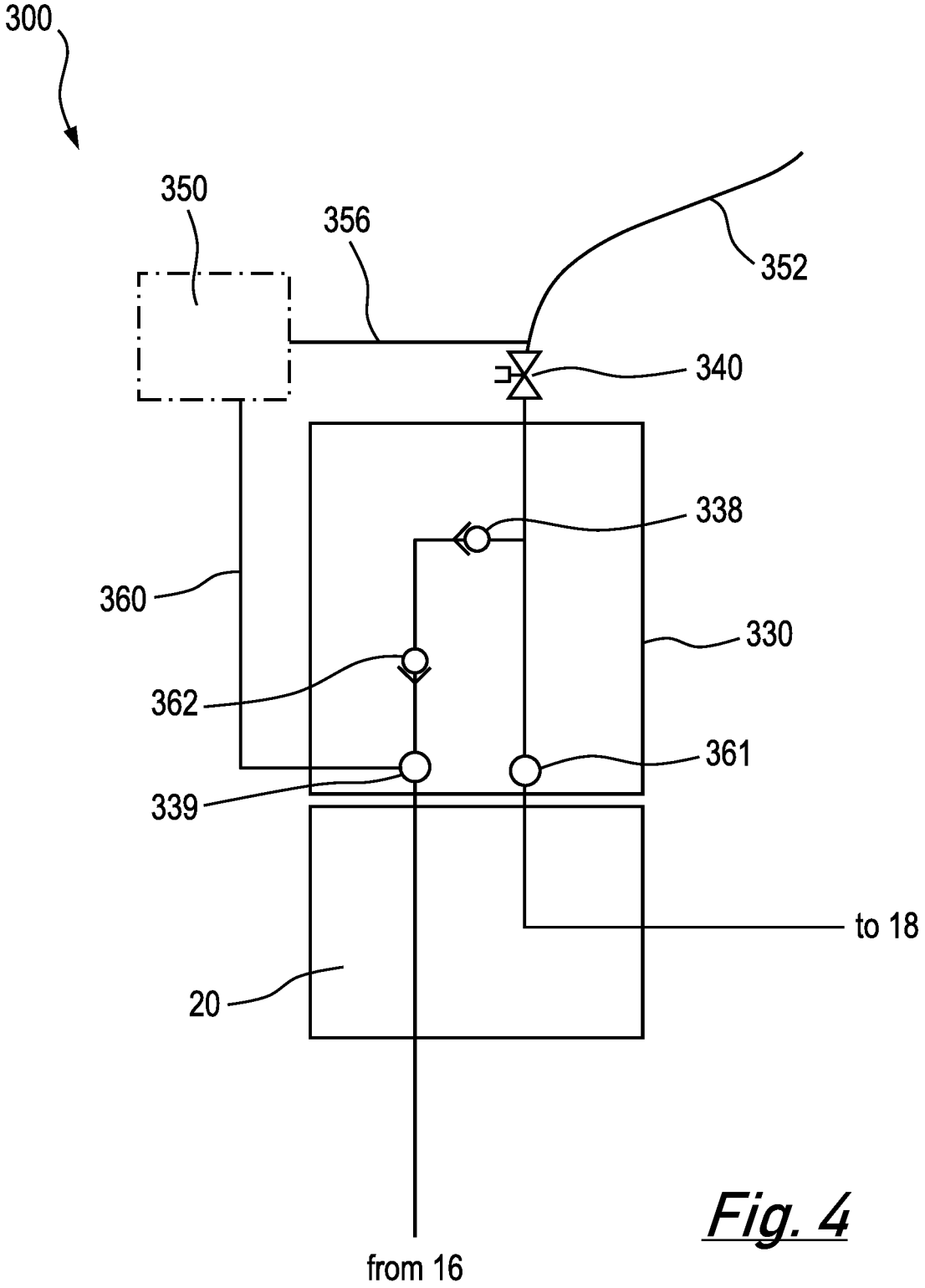
FIG. 4 is a schematic process and instrumentation diagram of a subsea-controlled system according to an embodiment of the invention.

FIG. 4 is a schematic representation of a system according to an alternative embodiment of the invention. The system, generally shown at 300, is similar to the system 200 incorporating the module 230, and will be understood from FIGS. 1 to 3 and their accompanying description. Like features are given like reference numerals incremented by 100. The system 300 differs from the system 200 in that the control module 350 is located locally, in a subsea location at or close to the module 330. The control module 350 receives a signal indicative of an adverse condition of the fluid, and controls the dosing valve 340 to enable a counteracting chemical to flow into the production fluid before it enters the production flow system 18.

Figure 5:
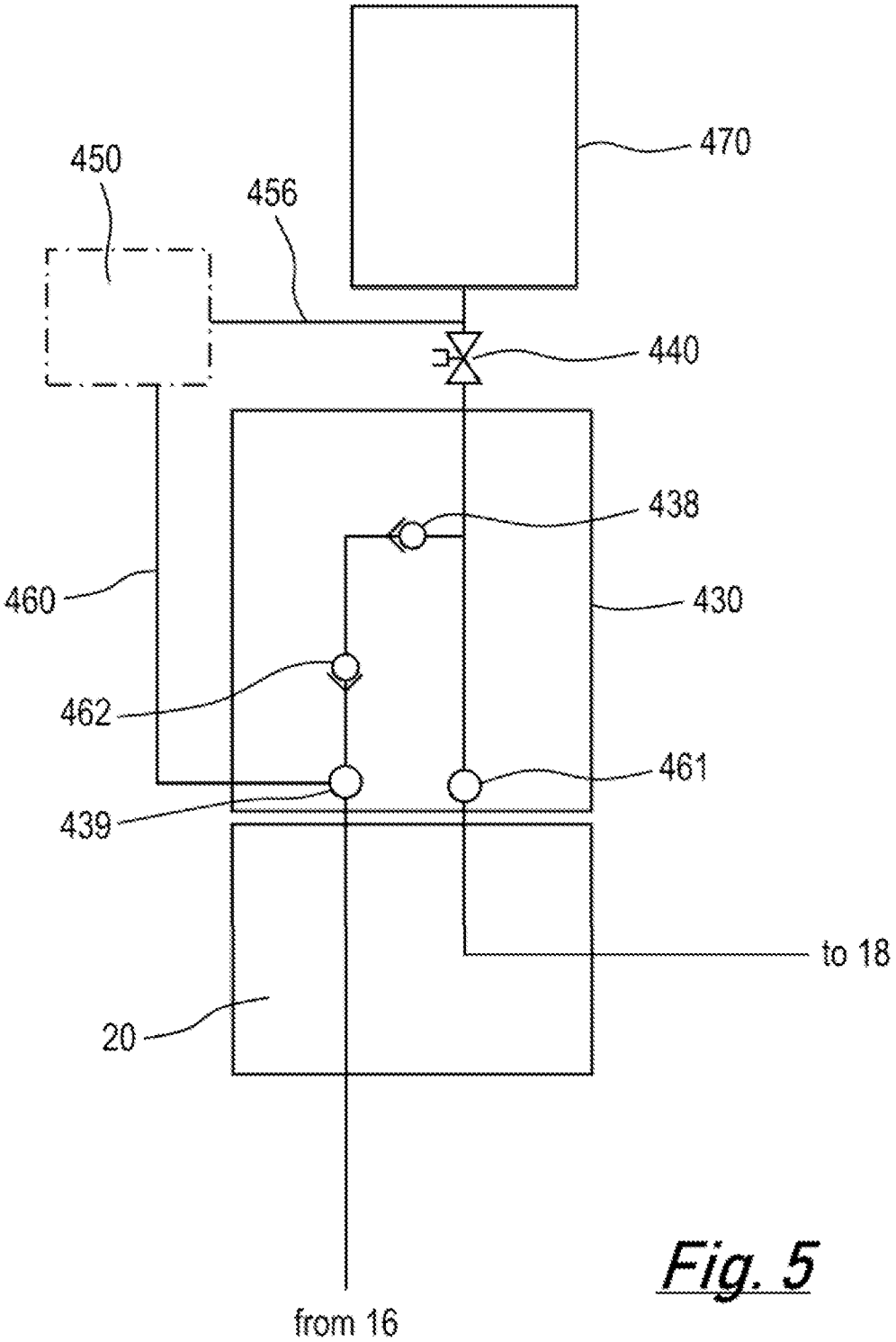
FIG. 5 is a schematic process and instrumentation diagram of a subsea-controlled system according to an alternative embodiment of the invention.

FIG. 5 is a schematic representation of a system according to an alternative embodiment of the invention. The system, generally shown at 400, is similar to the system 300 incorporating the module 330, and will be understood from FIGS. 1 to 4 and their accompanying description. Like features are given like reference numerals incremented by 100. The system 400 differs from the system 300 in that rather than delivering the second treatment chemical from a flowline or hose from a vessel, the apparatus comprises a reservoir 470 of the second treatment chemical at or near the module 430 in a subsea location.

It will be appreciated that variations to the control configurations described with reference to FIGS. 3 to 5 are within the scope of the invention, and include combinations of local and remote control, and control from ROVs, subsea control modules, or other subsea equipment. The control of dosing may be implemented automatically by the control module, or may be user-operated based on signals received from the sensors.

Figure 6A:
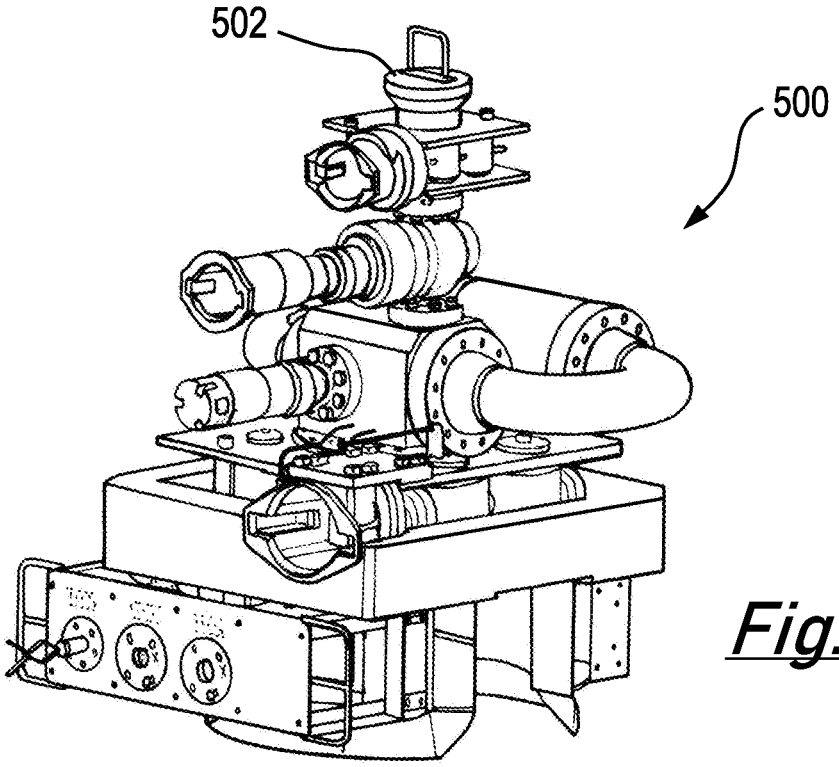
FIGS. 6A and 6B are alternative isometric views of an apparatus in accordance with an embodiment of the invention.
Figure 6B:
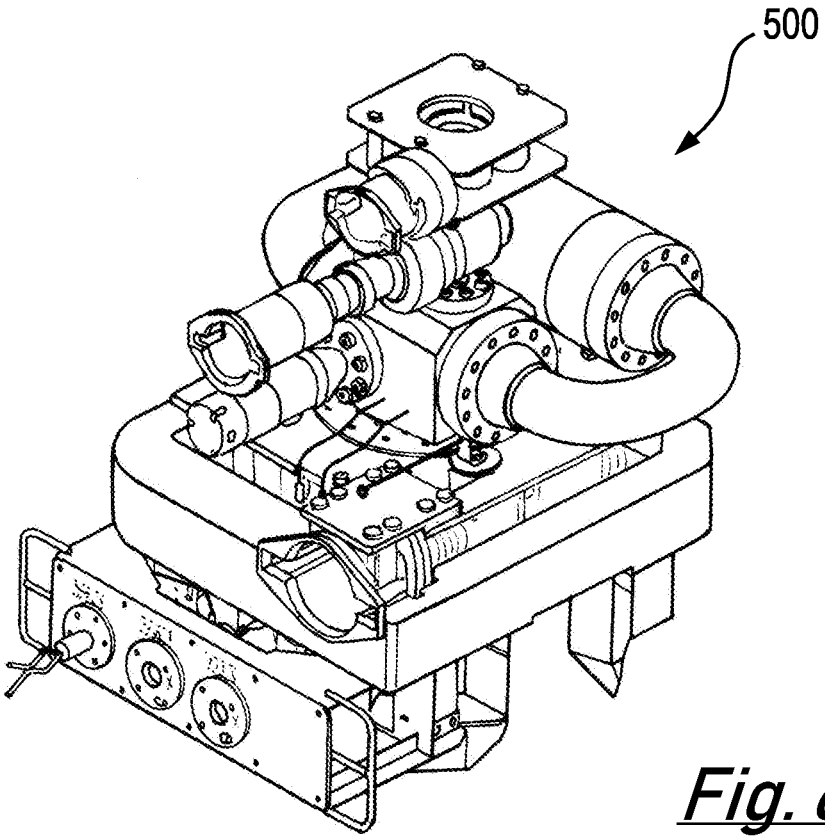

FIGS. 6A and 6B are alternative isometric views of an apparatus 500 according to an embodiment of the invention, and show an example of how the module may be physically laid out. FIG. 6A shows the module 500 with a blind cap 502 in place, and FIG. 6B shows the apparatus with the blind cap removed.

Figure 7:
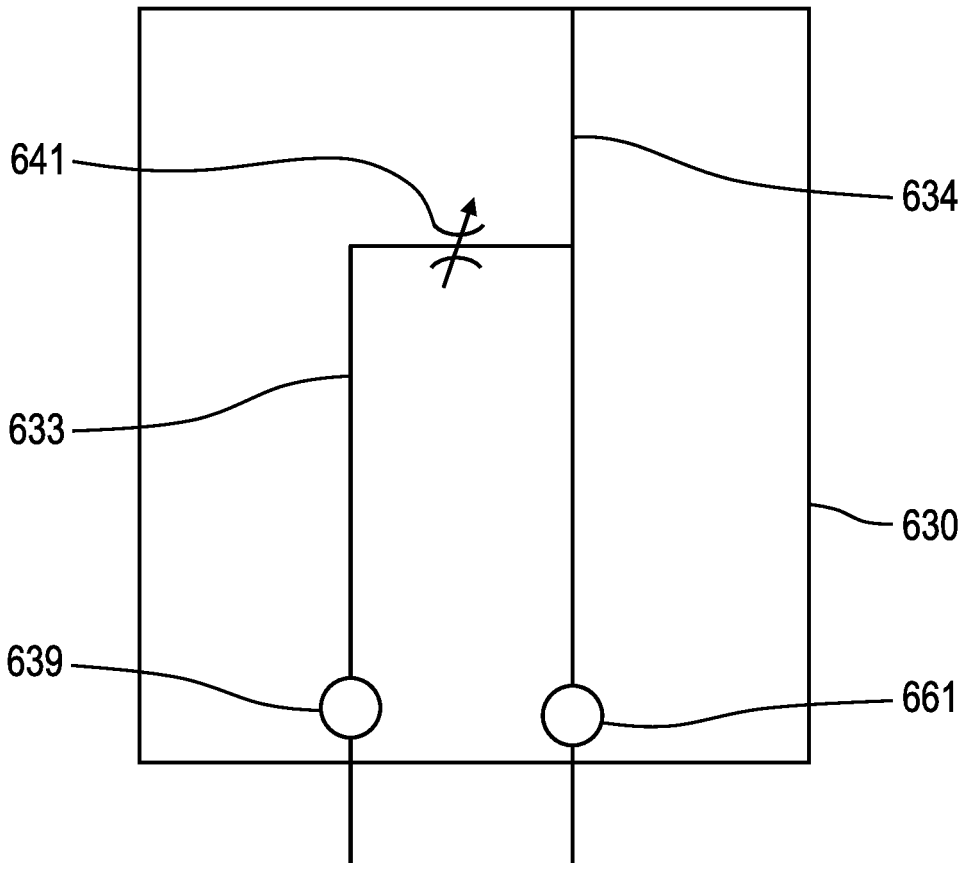
FIG. 7 is a schematic process and instrumentation diagram of an apparatus according to an embodiment of the invention.

FIG. 7 is a simplified schematic representation of a module 630 according to a further alternative embodiment of the invention. The module 630 is similar to the module 230 and will be understood from FIGS. 1 to 5 and their accompanying description. Like features are given like reference numerals incremented by 400. For clarity, FIG. 7 shows the module 630 only and omits features relating to the wider system (such as the flow access apparatus and the dosing system) and the control system, including a control module, control lines and the source of the treatment chemical. However, it will be appreciated that any of the control configurations and the like, described with reference to the previous drawings, may be used with this embodiment of the invention.

The module 630 differs from the module 230 in that it comprises a choke valve 641 instead of a check valve. The choke valve 641 is a controllable choke valve which is operable to create a flow restriction and pressure drop in the system, resulting in a favourable flow route for the second treatment chemical upon entry into the module via the dosing valve (not shown). The pressure drop generated by the choke valve 641 causes the second treatment chemical to preferentially flow through the second bore 634 in the production flow system side of the module, and inhibits or prevents flow of the second treatment chemical to the first bore 633.

Although the choke valve 641 is shown instead of a check valve, it will be appreciated that alternative arrangements of the flow paths within the module 630—including the provision of additional valves—may be implemented. For example, the choke valve 641 may be provided in an alternative position within the module 630, and/or may be provided alongside one or more check valves. Alternatively, the choke valve 641 may be replaced with a different type of valve or flow restriction as appropriate, to cause preferential flow of the second treatment chemical to the production side.

Figure 8:
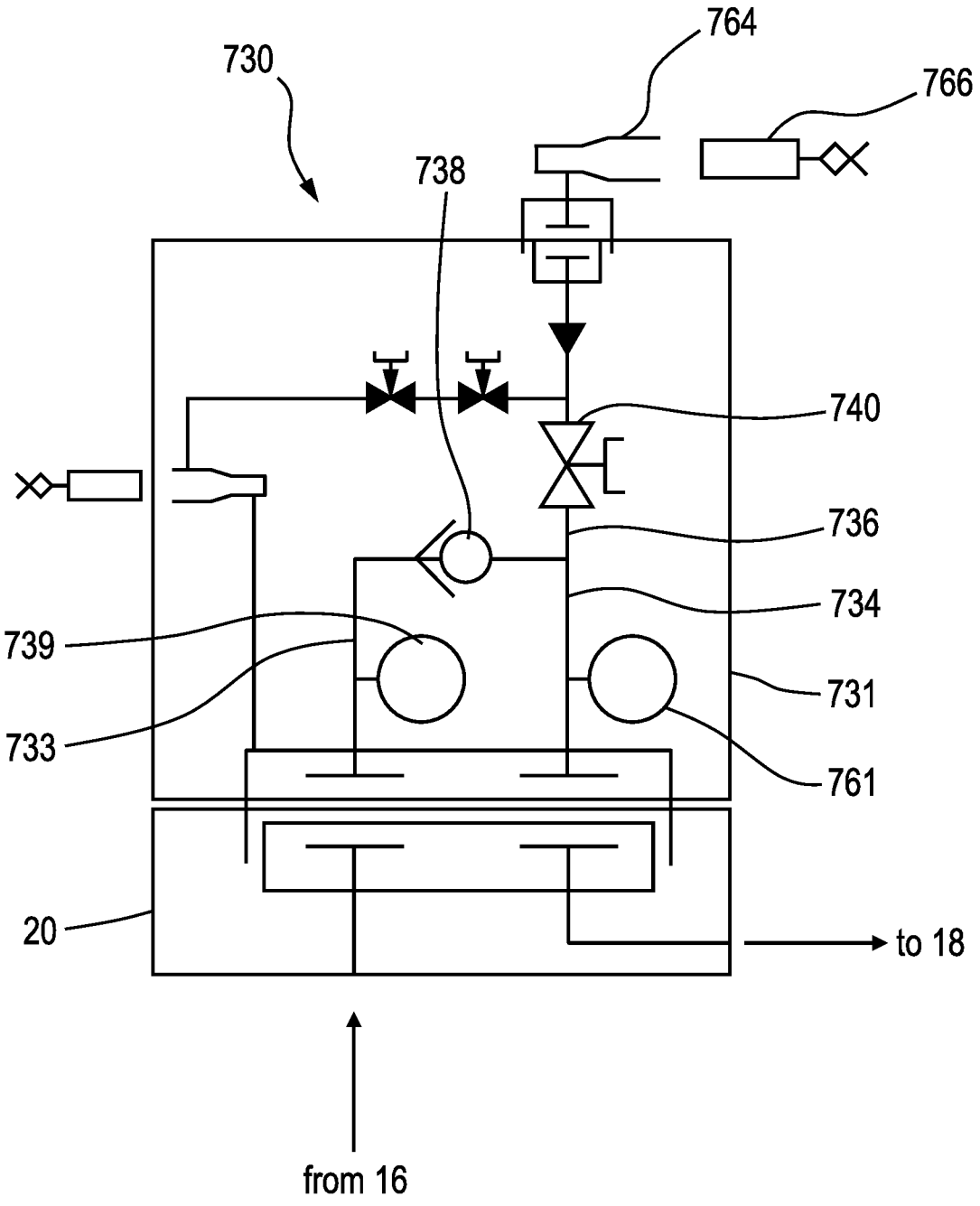
FIG. 8 is a schematic view of an apparatus according to an alternative embodiment of the invention.

Although the foregoing description describes a module for preventing or reducing flow of a treatment chemical into a subsea production flow system, it will be appreciated that a similarly configured module may also be utilised for alternative purposes. For example, FIG. 8 shows a module 730 according to a further alternative embodiment of the invention. The module 730 is functionally similar to the module 230, with like features given like reference numerals incremented by 500. The module 730 is shown connected to a dual bore flow access apparatus 20. However, for clarity, FIG. 8 omits features relating to the wider flow system. A first bore 733 of the module 730 extends through the body 731 from the lower interface connection to the jumper flowline connector 16 of a subsea Christmas tree and a second bore 734 extends through the body 731 from the lower interface connection to the production flow system 18.

The module 730 is for use in gas lift operations, to facilitate the injection of gas into the production flow system to aid hydrocarbon recovery. The module 730 also functions to prevent injected gas from entering the subsea well.

The module 730 comprises an internal valve 740 to control the injection of gas into the production flow system. It will be appreciated this this valve may alternatively be external to the body 731 of the module 730 if required. Gas for injecting is supplied to the module 730 via a stab connection between a stab receptacle 764 of the module 730 and a stab connector 766. The stab connector may, for example, be a ROV hot stab connector.

In operation, the valve 740 functions to operably restrict or allow passage of gas through the inlet 736 and into the second bore 734 of production flow, whilst the check valve 738 prevents flow of the gas into the first bore 733. The injected gas mixes with the production flow and decreases the density of the production flow entering the production flow system 18, thereby aiding and/or increasing production.

It will be noted that the module 730 optionally also contains sensors, meters and/or other instrumentation 739, 761 for gauging properties and characteristics of the fluid and/or the flow. In this embodiment, 761 is a flow meter used for flow measurement to monitor and assess optimal gas injection rates.

Figure 9:
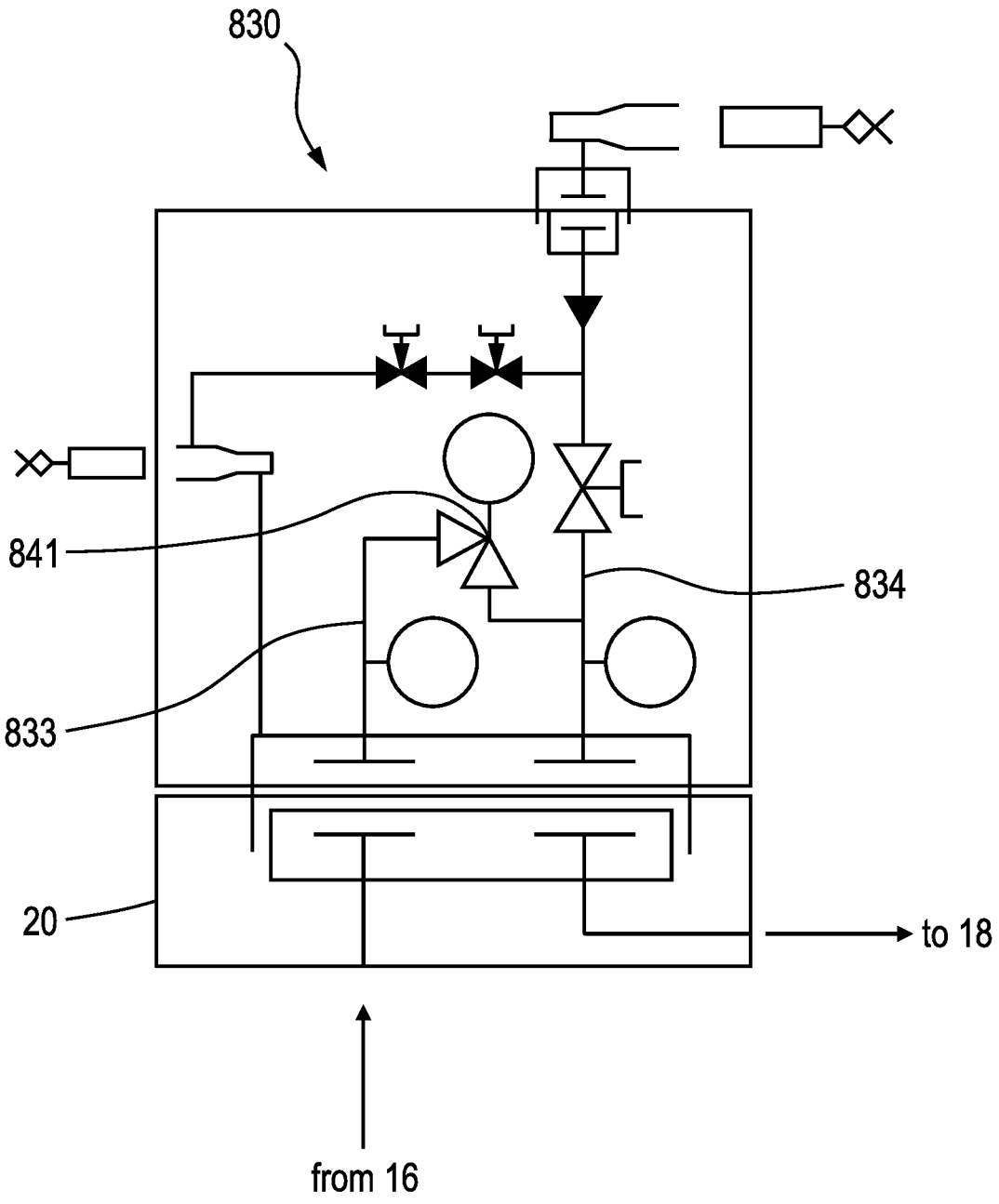
FIG. 9 is a schematic view of an apparatus according to a further alternative embodiment of the invention.

The module 830 shown in FIG. 9 is similar to the module 730 shown in FIG. 8. However, the module 830 differs from the module 730 in that it comprises a choke valve 841 instead of a check valve. The choke valve 841 is an electrically actuated choke valve operable to create a flow restriction and pressure drop in the system to cause the injected gas to preferentially flow through the second bore 834 in the production flow system side of the module, and inhibits or prevents flow of the injected gas to the first bore 833.

Although the flow access apparatus 20 has been described as being located on a jumper flowline connector 16 of a subsea tree, it will be appreciated that the flow access apparatus 20 may have an alternative location. For example, the flow access apparatus 20 may be configured to be connected to the flow system anywhere in the jumper flowline envelope, between an external flowline connector of a subsea production flow system or a manifold thereof, for example at a location selected from the group consisting of: a jumper flow line connector; upstream of a jumper flow line or a section of a jumper flow line; downstream of a jumper flow line or a section of a jumper flow line; a Christmas tree; a subsea collection manifold system; subsea Pipe Line End Manifold (PLEM); a subsea Pipe Line End Termination (PLET); a subsea Flow Line End Termination (FLET); and a subsea in-line tee (ILT).

It will also be appreciated that the production flow system 18 downstream of the flow access apparatus 20 may be a production pipeline, a jumper flowline or a flexible flowline. Alternatively, the production flow system 18 downstream of the apparatus 20 may be connected (directly or otherwise) to a production riser.

For example, referring back to FIGS. 8*a* and 8*b*, it may be desirable to perform a gas lift operation at or near the base of a production riser. The injected gas will decrease the density of the production flow thus aiding and/or increasing recovery up the riser. As such, the flow access apparatus 20 may be located on subsea infrastructure located near the production riser (which, as above, might not be a subsea tree). The injected gas decreases the density of the production flow exiting the module 730 and the flow access apparatus 20 and entering the flow system 18 which, in this alternative case is the production riser.

The invention provides an apparatus for introducing a fluid into a subsea production flow system, a system and a method of use. The apparatus comprises a first flow path through the apparatus for fluidly coupling a subsea well to a subsea production flow system and an inlet for receiving a fluid. A second flow path fluidly connects the inlet and the subsea production flow system. A valve is operable to control the flow of the fluid through the inlet to the subsea production flow system.

In one embodiment, the invention provides an apparatus for preventing or reducing flow of a first treatment chemical into a subsea production flow system, a system, and a method of use. The apparatus comprises a first flow path through the apparatus for fluidly coupling a subsea well to a subsea production flow system and an inlet for receiving a second treatment chemical. A second flow path fluidly connects the inlet and the subsea production flow system. A first sensor for detects a condition indicative of the first treatment chemical in the apparatus and transmits a signal to a control module; and a dosing valve is operable to control the flow of the second treatment chemical through the inlet to the subsea production flow system in response to a control signal from the control module. In a preferred embodiment, the sensor is a pH sensor, and on detection of a low pH, an alkaline chemical is dosed into the production fluid to raise the pH to an acceptable level. The invention has particular application to the reduction of flow of acidic production fluid through a production flow system following a scale squeeze operation.

In an alternative embodiment, the invention provides an apparatus for injecting a gas into a subsea production flow system, a system, and a method of use. The apparatus comprises a first flow path through the apparatus for fluidly coupling a subsea well to a subsea production flow system and an inlet for receiving the gas. A second flow path fluidly connects the inlet and the subsea production flow system. A valve is operable to control the flow of the gas through the inlet to the subsea production flow system. The invention has particular application to gas lift operations.

Various modifications to the above-described embodiments may be made within the scope of the invention, and the invention extends to combinations of features other than those expressly recited herein.

The invention claimed is:

1. An apparatus for introducing a fluid into a subsea production flow system, the apparatus comprising:

a first flow path through the apparatus for fluidly coupling a subsea well to a subsea production flow system;

an inlet for receiving the introduced fluid;

a second flow path for fluidly connecting the inlet and the subsea production flow system via at least part of the first flow path;

a valve operable to control the flow of the introduced fluid through the inlet to the subsea production flow system; and at least one flow barrier in the first flow path, preventing the passage of the introduced fluid from the inlet to the subsea well.

2. The apparatus according to claim 1, wherein the apparatus is configured to be connected to one or more flow access apparatus located on the flow system.

3. The apparatus according to claim 1, wherein the apparatus is configured to be connected to an external flowline connector of the flow system or a manifold thereof, at a location selected from the group consisting of a jumper flow line connector, upstream of a jumper flow line or a section of a jumper flow line, downstream of a jumper flow line or a section of a jumper flow line, a Christmas tree, a subsea collection manifold system, subsea Pipe Line End Manifold (PLEM), a subsea Pipe Line End Termination (PLET), a subsea Flow Line End Termination (FLET), and a subsea in-line tee (ILT).

4. The apparatus according to claim 1, wherein the apparatus is configured to be connected to a production riser, such that it is in fluid communication with the production riser.

5. The apparatus according to claim 1, wherein the at least one flow barrier is a flow barrier selected from the group comprising: a check valve, a flow restrictor, a choke valve and an adjustable choke valve.

6. The apparatus according to 1, wherein the apparatus comprises at least one sensor which is operable to detect a condition indicative of a first treatment chemical in the apparatus.

7. The apparatus according to claim 6, wherein the at least one flow barrier is disposed between the inlet and the at least one sensor.

8. The apparatus according to claim 6, wherein the at least one sensor is operable to transmit a signal to a control module and wherein the valve is operable to control the flow of a second treatment chemical through the inlet to the subsea production flow system in response to a control signal from the control module.

9. The apparatus according to claim 1, wherein the first and/or second flow path comprises additional instrumentation for monitoring fluid and/or flow properties such as pressure, temperature, flow rate and fluid composition.

10. The apparatus according to claim 9, wherein the instrumentation within the first and/or second flow paths is operable to feedback to a control module, and wherein properties of the flow operation are operable to be adjusted based on said feedback.

11. A method of introducing a fluid to a subsea production flow system, the method comprising:

providing an apparatus fluidly coupling a subsea well to a subsea production flow system via a first flow path, the apparatus further comprising an inlet for receiving the introduced fluid, a second flow path fluidly connecting the inlet and the subsea production flow system via at least part of the first flow path, a valve operable to control the flow of the introduced fluid through the inlet to the subsea production flow system, and at least one flow barrier preventing passage of the introduced fluid from the inlet to the subsea well;

flowing a production fluid from the subsea well into the apparatus;

controlling flow of the introduced fluid into the apparatus, through the inlet and into the subsea production flow system; and flowing the production fluid and introduced fluid to the subsea production flow system.

12. The method according to claim 11, comprising preventing or reducing flow of a first treatment chemical into the subsea production flow system.

13. The method according to claim 12, comprising detecting in the production fluid a condition indicative of a first treatment chemical by using at least one sensor in the apparatus.

14. The method according to claim 13, wherein the condition indicative of a first treatment chemical is a pH outside of a desired pH range, and wherein the second treatment chemical is a base substance, and/or an alkaline or caustic chemical selected to bring the pH of the production fluid to into a desired range.

15. The method according to claim 13, comprising transmitting a signal from the at least one sensor to a control module.

16. The method according to claim 15, comprising controlling the valve to control the flow of the second treatment chemical through the inlet to the subsea production flow system in response to a control signal from the control module.

17. The method according to claim 12, wherein the introduced fluid is a second treatment chemical and the method comprises controlling the flow of the second treatment chemical into the apparatus for the purpose of dosing the production fluid to counteract an effect of the first treatment chemical.

18. The method according to claim 11, wherein the introduced fluid is gas, and wherein the method comprises controlling flow of the gas into the apparatus, through the inlet and into the subsea production flow system.

19. A system for introducing a fluid to a subsea production flow system, the system comprising:

a subsea well;

a subsea production flow system;

an apparatus fluidly coupling the subsea well to the subsea production flow system via a first flow path, wherein the apparatus further comprises an inlet for receiving the introduced fluid, a second flow path fluidly connecting the inlet and the subsea production flow system;

wherein the apparatus further comprises a valve operable to control the flow of the introduced fluid through the inlet to the subsea production flow system; and wherein the apparatus further comprises at least one flow barrier in the first flow path, preventing the passage of the introduced fluid from the inlet to the subsea well.

20. The system according to claim 19, wherein the apparatus is connected to a flow access apparatus.

21. The system according to claim 20, wherein the flow access apparatus is connected to a jumper flowline connector in the jumper flowline envelope of a subsea tree and a jumper flowline of the production flow system.

22. The system according to claim 20, wherein the apparatus comprises an interface connected to an interface of the flow access apparatus, wherein the interface comprises first and second bores, the first bore being fluidly coupled to the subsea well and the second bore being fluidly coupled to the subsea production flow system, and wherein the first flow path connects the first and second bores.

23. The system according to claim 19, wherein the apparatus is fluidly connected to a production riser.

24. The system according to claim 19, wherein the flow access apparatus is connected to an external flowline connector of the flow system or a manifold thereof, at a location selected from the group consisting of a jumper flow line connector, upstream of a jumper flow line or a section of a jumper flow line, downstream of a jumper flow line or a section of a jumper flow line, a Christmas tree, a subsea collection manifold system, a subsea Pipe Line End Manifold (PLEM), a subsea Pipe Line End Termination (PLET), a subsea Flow Line End Termination (FLET), and a subsea in line tee (ILT), and a jumper flowline of the production flow system.

* * * * *